US005348413A

United States Patent [19]

Sklar

[11] Patent Number: 5,348,413

[45] Date of Patent: Sep. 20, 1994

[54] CONDUIT SEALING ASSEMBLY FOR NEON LIGHTING DISPLAYS

[76] Inventor: Albert Sklar, 3513 Villa Terrace, San Diego, Calif. 92104

[21] Appl. No.: 5,809

[22] Filed: Jan. 19, 1993

[51] Int. Cl.[5] ..... F21V 19/00; F21V 31/02; F21V 33/00

[52] U.S. Cl. ..... 403/24; 362/217; 362/263; 439/227; 40/545

[58] Field of Search ..... 403/24; 362/217, 221, 362/263, 265; 285/354, 52; 40/545; 439/227

[56] References Cited

U.S. PATENT DOCUMENTS

| | | | |
|---|---|---|---|
| 2,141,207 | 12/1938 | Duntze | 40/545 |
| 2,683,257 | 7/1954 | Gasser-Steiner | 362/217 X |
| 2,774,947 | 12/1956 | Frensch | 362/217 X |
| 4,460,226 | 7/1984 | Hageman | 40/545 X |
| 4,842,535 | 6/1989 | Velke, Sr. et al. | 362/217 X |
| 5,008,787 | 4/1991 | Sklar et al. | 362/221 |
| 5,045,000 | 9/1991 | Trame et al. | 40/545 X |
| 5,145,248 | 9/1992 | Chuan | 362/217 |

*Primary Examiner*—Randolph A. Reese
*Assistant Examiner*—Christopher J. Novosad
*Attorney, Agent, or Firm*—Brown, Martin, Haller & McClain

[57] ABSTRACT

A conduit sealing assembly for sealing a conduit for carrying high voltage wiring from a neon tube through a backing panel of the neon display includes a hollow connector member for securing to the backing panel so as to project through an opening in the panel. One end of the connector member on the rear side of the panel is secured to a conduit for guiding the wiring from the panel for connection to a power supply. A hollow sealing plug is secured in the opposite end of the connector member, and a hollow insulating tube for guiding wiring from the neon tube through the backing panel has one end inserted into the connector member through the plug member, which seals against the surface of the tube to provide a weather proof seal.

6 Claims, 1 Drawing Sheet

CONDUIT SEALING ASSEMBLY FOR NEON LIGHTING DISPLAYS

BACKGROUND OF THE INVENTION

The present invention relates generally to neon light displays and is particularly concerned with a sealing assembly for sealing the conduits carrying high voltage wiring for supplying power to a neon light display through a mounting surface supporting the neon tubing.

Neon light displays are typically mounted on a back plate or wall surface and are energized by a high voltage supply on the other side of the mounting surface. The electrical wiring connecting the high voltage supply to the neon tube must therefore pass through the wall or mounting surface to connect to the neon tube electrodes.

The ends of the high voltage wires must be connected to the neon tube electrodes, and this connection must not be exposed. In our U.S. Pat. No. 5,008,787, a system for insulated support of neon lights was described, in which a glass insulation cup was used to shield the high voltage connection at the electrodes. The glass insulating cup slides over the exposed wire ends and is secured to the background surface, protecting and shielding the high voltage connection.

In order to connect through the background surface and building wall to a high voltage supply inside a building, the wiring must pass through a suitable opening to the background surface, and must be shielded from the elements as it passes through the background surface. Typically, a special glass housing or shell having a rim at one end, known as a PK housing, extends through a hole in the neon background surface or plate from the rear to the front side of the plate, and receives and encloses the horizontal end of the bent neon glass tube. The wiring extends through the PK housing and through a standard electrical wiring conduit connected to the other end of the PK housing and leading to the high voltage supply. A rubber boot is used to surround the rim of the PK housing and the bent neon glass tubing where it extends into the housing.

This known mounting and connecting assembly for high voltage wiring connections has a number of disadvantages. Firstly, the hole in the neon display back plate must be relatively large to receive the glass PK housing, typically around 1 15/16 inches in diameter. Secondly, the rubber boot is not suitable for outdoor use since it is not completely water tight and does not provide adequate protection against the elements. Thus, some water will typically leak into the connection with this arrangement if it is used outdoors.

SUMMARY OF THE INVENTION

It is an object of the present invention to provide a new and improved sealing assembly for insulated sealing of tubing for high voltage wiring extending through a wall or back plate of a neon display.

According to the present invention, a sealing assembly is provided for sealed connection of conduits carrying high voltage wiring through a wall or backing of a neon display. The assembly comprises a connector member having a through bore for extending through an opening in a wall or back plate having a front face and a rear face, the connector member having fastener devices such as screw threads at its opposite front and rear ends on opposite sides of the wall, a hollow tube of insulating material for carrying electrical wiring having a first end projecting into the front end of the connector member through bore, the hollow tube having a diameter smaller than that of the connector member, and an annular plug member in sealing engagement with the outer surface of the tube where it extends into the front end of the connector member, the plug member extending into the connector member for sealing engagement with the inner surface of the connector member through bore so that it seals the gap between the tube and connector member where the tube extends into the connector member bore.

The plug member preferably comprises a hollow cylindrical bushing with an outer diameter substantially matching that of the connector member through bore, and an inner diameter substantially matching the outer diameter of the tube, and preferably has an outwardly projecting annular rim or collar at its outer end for bearing against the end surface of the connector member. A bushing or outer nut having a central opening for sliding engagement over the tube has suitable fastener configurations such as internal screw threads for releasable engagement with the outer end of the connector member, and an inwardly projecting annular rim or end wall at one end for engagement with the outer end of the plug member so as to clamp the annular rim of the plug member between the end of the connector member and the end wall of the end cap. The inner end of the connector member is secured to a suitable conduit for carrying the electrical wiring from the first end of the tube to the power supply.

The plug member is made of a suitable resilient and waterproof material, such as a resilient plastic material or rubber. With this arrangement, a water and weather proof connection can be made from neon tubing electrodes through a mounting surface for the neon light display. The plug member or seal preferably has a pair of spaced, integral O-ring seals built into its inner surface for sealing against the outer surface of the tube. The plug member is secured in the end of the connector member, and the end of the glass tube is then pushed through the plug member into the connector member. The structure of the plug member with integral O-ring seals allows the tubing to slip easily through the plug into the desired position, the plug sealing against the tubing at the O-ring locations.

This arrangement eliminates the PK housing and allows outdoor neon light displays to be directed to an indoor high voltage supply by means of a sealed connecting assembly which is sealed against the elements. It can be used with any type of neon lighting which is surface mounted to a wall or raceway.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
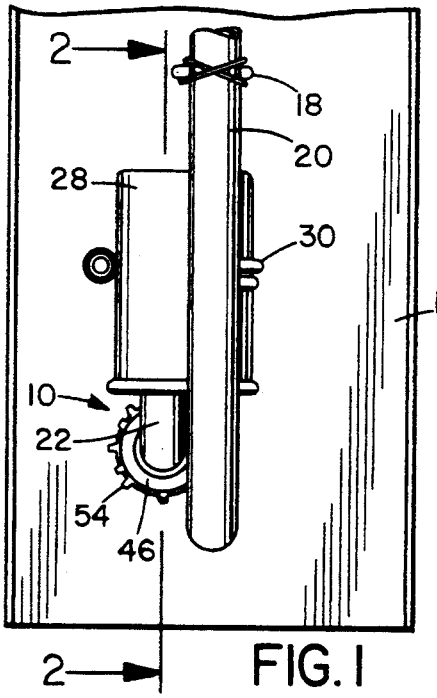
FIG. 1 is a front view of a typical neon end connection and a sealing assembly according to a preferred embodiment of the invention for sealing of the high voltage wiring supplying power to the end connection.
Figure 2:
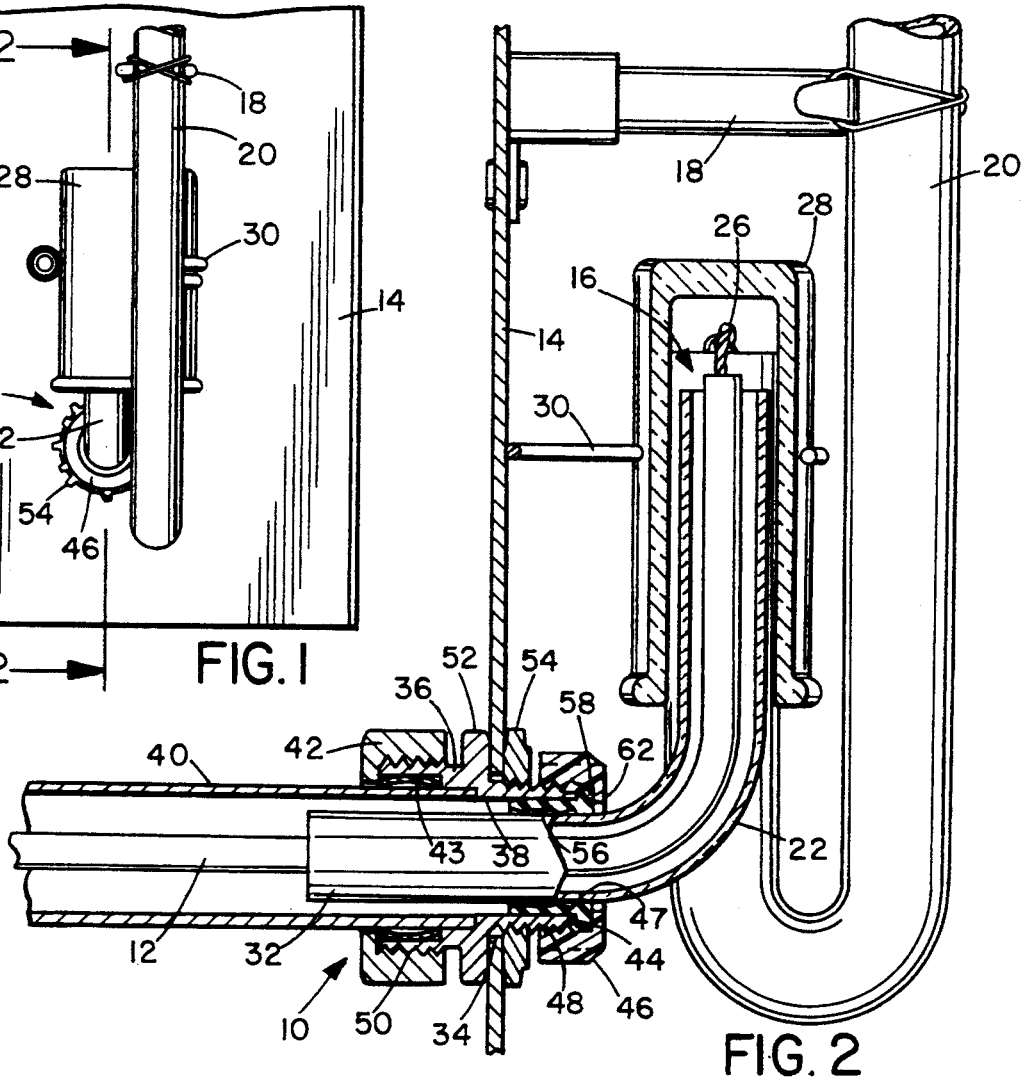
FIG. 2 is an enlarged sectional view taken on line 2—2 of FIG. 1.
Figure 3:
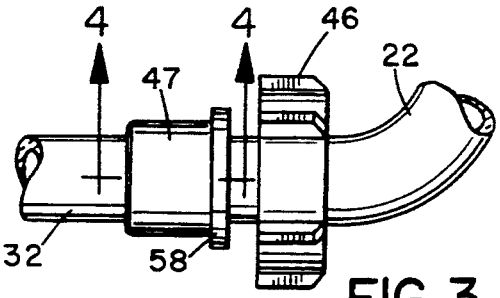
FIG. 3 is similar to a portion of FIG. 2, separated to show the sealing plug and plastic retainer bushing.

FIGS. 1–3 of the drawings illustrate a conduit sealing assembly 10 according to a preferred embodiment of the present invention for sealing conduits carrying high voltage electrical wiring 12 through a back plate 14 for a neon lighting display. Wiring 12 extends to neon tubing end connection 16.

In a neon lighting display, a number of neon tubes containing illuminating conductive gases are bent to form the desired design or lettering, and secured to the back wall of a letter 14, which may be of metal, glass or the like, via supports 18. The end of one such neon tube 20 can be seen in FIGS. 1 and 2. The gas in tube 20 is ignited by a high voltage power supply connected across electrodes at opposite ends of the tube. Electrical wiring 12 extends from the power supply (not illustrated) through wall 14 to the end of the neon tube. A similar connection may be made at the opposite end of the tube, or at the end of the display, where the tubes are connected end to end in series along the length of the display as in U.S. Pat. No. 5,008,787 referred to above.

Neon tube 20 is of the so-called "double-back" type and is arranged with its end pointing in any desired direction. Wiring 12 extends from connection 16 through a bent glass tube 22 having a 90° bend or corner to direct the wiring from a vertical to a horizontal orientation. The neon tube electrode wire is crimped or twisted securely to the end of wiring 12 extending out of the vertical end of tube 22 to form a crimp connection 26, as best illustrated in FIG. 2. A downwardly facing, insulating glass cup 28 is placed over the exposed wiring ends to insulate and shield them from the elements. Cup 28 is described in more detail in U.S. Pat. No. 5,008,787, of Sklar et al., issued Apr. 16, 1991, the contents of which are incorporated herein by reference. Hangers or brackets 30 are optionally used to fasten the cup to the back wall or plate 14.

The horizontal end portion 32 of glass tube 22 extends through an opening 34 provided in the wall or letter back 14 and into the end of a standard ½ inch EMT conduit 40 which guides the wiring 12 from back plate 14 through any intervening building wall to the power supply. The tube 22 and conduit 40 are connected together and supported relative to the wall or back of a letter 14 via connecting and sealing assembly 10. Connecting assembly 10 basically comprises a hollow connector member or sleeve 36 of metal which is secured in opening 34 via a first fastener or lock nut 54. Member 36 has a through bore 38, through which tube end portion 32 projects, and opposite externally threaded end portions 48, 50 of different diameters. End portion 50 is secured to conduit 40 on the rear side of wall or letter back 14 via a second fastener or compression nut 42 and compression ring 43 located between conduit 40 and the inner diameter of connector member end portion 50.

The tube end portion 32 is retained on the threaded end portion 48 on the front side of back plate 14 via a third fastener nut or insulating plastic retainer bushing 46 and sealing plug member 47 which is secured between the bushing 46 and the outer or front end 44 of connector member 36.

Connector member 36 is preferably a standard ½ inch EMT connector such as EMT conduit fitting No. 250-DC2 or 520-DC2 manufactured by Bridgeport Fittings, Inc., or an equivalent fitting. These fittings provide enough thread to allow easy application of the bushing. Compression nut 42 and compression ring 43 may comprise a standard Rain-tight conduit connector for ½ inch EMT conduit. Member 36 has an annular flange 52 located between threaded end portions 48 and 50, and is secured to back plate 14 via the annular locking nut 54 which is threaded onto end portion 48 and clamps the back plate between flange 52 and nut 54.

Figure 4:
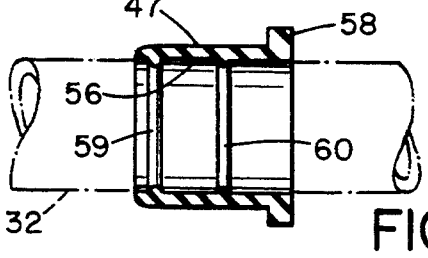
FIG. 4 is an enlarged cross-sectional view on the lines 4—4 of FIG. 3.

Plug member 47 is illustrated in more detail in FIG. 4 and comprises a generally cylindrical sleeve of resilient, waterproof material such as plastic or rubber, which is a close sliding fit over the end portion 32 of glass tube 22. Sealing plug member 47 has a through bore 56 of diameter slightly greater than the tube end portion 32, and an outer diameter substantially matching the inner diameter of the connector member through bore at the outer end 44 of the connector member. An annular, outwardly projecting flange 58 is provided at the end of plug member 47 for bearing against the end 44 of connector member 36 with the remainder of the plug member projecting into the connector member bore for sealing engagement with the internal surface of the bore. A pair of spaced O-ring seals 59, 60 are integrally formed on the inner surface of the plug member through bore 56 for sealing engagement with the outer surface of tube 22 when the plug member is held in position by end bushing 46.

FIG. 3 illustrates the plug member 47 and bushing 46 on the end portion 32 prior to attachment to connector member 36. The plug member 47 is positioned on end portion 32 so as to project into the connector member 36 with the rim 58 bearing against the outer end 44. Bushing 46 has internal screw threads for threaded engagement with the external screw threads of end portion 48 of the connector member, and an in-turned annular end face or rim 62 for bearing against rim 58 of the sealing plug 47 so as to clamp the plug rim 58 between the end 44 and rim 62, as best illustrated in FIG. 2. The plug member is therefore sealed against the inner surface of the connector member through bore, and against the outer surface of tube portion 32 via O-ring seal formations 59 and 60, plugging the gap between the connector member and glass tube and sealing the connection against ingress of moisture or dirt. Wiring 12 extends through the connection and along conduit 40 to the high voltage supply.

Figure 5:
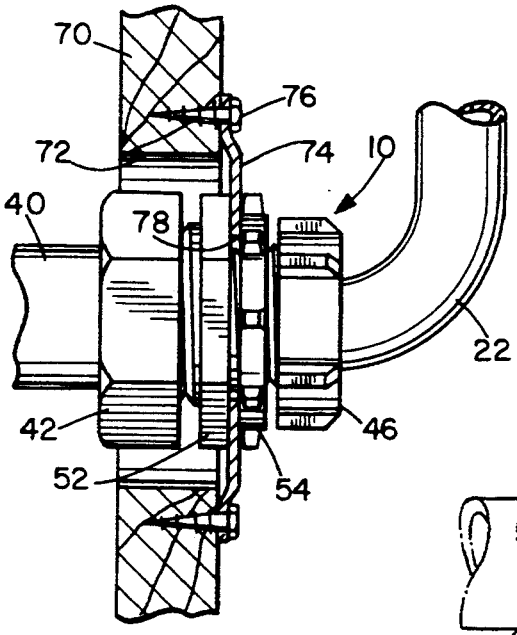
FIG. 5 is a side elevation view of a portion of FIG. 2, showing the adaptation to a wooden mounting surface.

FIG. 5 illustrates a modified connection in which the backing surface of the neon lighting is a thicker, wooden panel 70. The thickness of the panel is such that the connector member 36 cannot be secured directly to the panel as in FIGS. 1 and 2. The actual connector assembly 10 in FIG. 5 is identical to that of FIGS. 1–4, and like reference numerals have been used as appropriate. However, since the wooden panel is thicker than wall or letter backing 14, the connector member 36 is mounted in a larger diameter opening 72 in panel 70 via mounting plate 74 which is secured across the opening 72 via screws 76 or equivalent fasteners. Plate 74 has an opening 78 through which the connector member extends, and the connector member is secured to the plate 74 via connecting nut 54 which is tightened against the outer face of plate 74 so as to clamp the plate between the flange 52 and nut 54.

The procedure for installing wiring for supplying power to a neon light display using the connector assembly as described above is as follows. The connector member 36 is first installed into the opening in the sheet metal backing plate 14 and secured in position via lock nut 54, which also ensures the required ground path. A measured piece of EMT conduit 40 is then secured to the rear end of connector member 36 and pushed through a one inch plus hole in the building wall, and the backing plate is then secured in place.

The end of wiring 12 extending through conduit 40 and connector member 36 is then threaded through bent glass tube 22. Sufficient insulation is stripped from the end of the wiring 12 projecting from the vertical end of tube 22 to make the crimped or twisted connection 26 to the neon tube electrode.

The sealing plug member 47 is then inserted into the end 44 of the connector member 36, and the insulating nut or bushing 46 is screwed onto the end portion 48 of the connector. Any standard insulating bushing may be used, such as the Regal #931. The glass tube 22 is then inserted into the sealing plug member 47 and pushed all the way into the connector, into the position illustrated in FIG. 2. The integral O-ring seals on the inner surface of plug member 47 allow the tube 22 to be slipped easily through the plug member to the desired position, while ensuring an effective seal is made when the tube reaches the desired position. A similar connection is made for both ends of the neon lighting display.

At this point the neon tubing can be installed on the wall or letter back 14. The stripped end of wiring 12 is crimped to the neon tube electrode wire. The glass cup is then installed and the cup hanger or spacer is fastened to the backing plate, making sure that the closed end of the cup is above the horizontal plane. The electrical wiring is connected to the high voltage supply in a conventional manner, as required by the particular installation.

This arrangement provides an effective seal against moisture and the elements around the glass tubing 22 carrying the high voltage wiring. The sealing plug member is positioned in the end of the connector member and secured in place before the end of the glass tube 22 is inserted through the bushing and into the connector member. The shape of the sealing plug member enables this to be done relatively easily while still ensuring an adequate seal against water and the elements. Thus, neon lighting can be used outdoors even when exposed to rain and snow.

Although a preferred embodiment of the present invention has been described above by way of example only, it will be understood by those skilled in the field that modifications may be made to the disclosed embodiment without departing from the scope of the invention, which is defined by the appended claims.

I claim:

1. An assembly for sealing a conduit carrying high voltage wiring through a wall or letter back of a neon lighting display, comprising:

a connector member having a through bore and first securing means for securing the connector member to project through an opening in a backing of a neon lighting display;

the connector member having opposite front and rear ends for location on front and rear sides, respectively, of the backing;

a first conduit having a first end for securing to the rear end of the connector member for guiding electrical wiring from the backing for connection to a high voltage. Supply;

second securing means for securing the first end of the first conduit to the rear end of the connector member;

a sealing plug of resilient, waterproof material mounted at the front end of the connector member and projecting into the connector member through bore, the sealing plug having a through bore;

third securing means for securing the sealing plug to the front end of the connector member;

a hollow tube of insulating material having opposite first and second ends, the first end of the tube projecting into the connector member through said sealing plug, the sealing plug being in sealing engagement with the tube where it projects into the connector member; and the sealing plug comprising a hollow cylindrical sleeve having an annular, radially outwardly projecting rim at one end for locating against the front end of the connector member, the third securing means comprising a nut member for securing said rim between the nut member and front end of the connector member.

2. An assembly for sealing a conduit carrying high voltage wiring through a wall or letter back of a neon lighting display, comprising:

a connector member having a through bore and first securing means for securing the connector member to project through an opening in a backing of a neon lighting display;

the connector member having opposite front and rear ends for location on front and rear sides, respectively, of the backing;

a first conduit having a first end for securing to the rear end of the connector member for guiding electrical wiring from the backing for connection to a high voltage supply;

second securing means for securing the first end of the first conduit to the rear end of the connector member;

a sealing plug of resilient, waterproof material mounted at the front end of the connector member and projecting into the connector member through bore, the sealing plug having a through bore;

third securing means for securing the sealing plug to the front end of the connector member;

a hollow tube of insulating material having opposite first and second ends, the first end of the tube projecting into the connector member through said sealing plug, the sealing plug being in sealing engagement with the tube where it projects into the connector member; and the through bore of the sealing plug having an inner diameter sized to fit tightly in the diameter of said hollow tube, and at least one O-ring seal is located inside the plug bore between the plug and tube.

3. The assembly as claimed in claim 2, wherein the O-ring seal is integrally formed on the inner surface of the plug bore.

4. The assembly as claimed in claim 3, wherein the plug has a pair of spaced, integral O-ring seal formations on its inner surface for sealing engagement with the outer surface of said hollow tube.

5. The assembly as claimed in claim 2, wherein the hollow tube has a 90° bend between its opposite ends for directing wiring from a vertical to a horizontal orientation.

6. A method of sealing an insulating tube for carrying electrical wiring through an opening in a neon display backing plate, comprising the steps of:

securing a connector member having a through bore through an opening in a neon display backing plate;

securing a conduit to one end of the connector member on the rear side of the backing plate;

inserting a sealing plug having a through bore into the opposite, second end of the connector member;

securing the sealing plug to the connector member;

extending electrical wiring through the conduit and connector member out of the second end of the connector member, and through a hollow tube of insulating material; and inserting the end of the hollow tube through the sealing plug into the connector member to locate an O-ring seal inside the sealing plug between the plug and tube.

* * * * *